US005329945A

United States Patent [19]

Irikura et al.

[11] Patent Number: 5,329,945

[45] Date of Patent: Jul. 19, 1994

[54] APPARATUS FOR DISCHARGING DEFECTIVE FILTER CIGARETTES DURING THE MANUFACTURE OF FILTER CIGARETTES

[75] Inventors: Takayuki Irikura; Minoru Suzuki, both of Tokyo, Japan

[73] Assignee: Japan Tobacco Inc., Tokyo, Japan

[21] Appl. No.: 110,942

[22] Filed: Aug. 24, 1993

[30] Foreign Application Priority Data

Aug. 24, 1992 [JP] Japan ..... 4-224146

[51] Int. Cl.[5] ..... A24C 5/34; A24C 5/345

[52] U.S. Cl. ..... 131/94; 131/280; 131/907; 198/372; 198/438; 198/471.1; 209/535

[58] Field of Search ..... 131/94, 96, 280, 84.1, 131/88, 907; 198/471.1, 493, 438, 372; 209/537, 535

[56] References Cited

U.S. PATENT DOCUMENTS 3,782,523 1/1974 Giatti ..... 198/438 X
4,484,591 11/1984 Wahle et al. ..... 131/280
4,590,952 5/1986 Manfredini ..... 131/94
4,640,013 2/1987 Cristian ..... 131/94

FOREIGN PATENT DOCUMENTS 1144740 3/1969 United Kingdom ..... 209/535

*Primary Examiner*—Jennifer Doyle

[57] ABSTRACT

A discharge apparatus of the present invention includes a discharge drum replacing one transportation drum in a drum train of a filter attachment, transportation grooves on a drum shell of the discharge drum, jet holes opening in the bottom of each transportation groove so that the jet holes of each two adjacent transportation grooves open in different positions, a control sleeve fixed in the drum shell, jet grooves formed over a predetermined rotational angle zone on the outer peripheral surface of the control sleeve and connectable to their corresponding jet holes, blow pressure lines for independently introducing a blow pressure into the individual jet grooves, and solenoid valves arranged individually in the middle of the blow pressure lines and used independently to open and close the blow pressure lines.

4 Claims, 8 Drawing Sheets

APPARATUS FOR DISCHARGING DEFECTIVE FILTER CIGARETTES DURING THE MANUFACTURE OF FILTER CIGARETTES

BACKGROUND OF THE INVENTION

1. Field of the Invention

The present invention relates to an apparatus for discharging some of filter cigarettes from a transportation line to effect removal of defective filter cigarettes or sampling inspection during the manufacture of the filter cigarettes.

2. Description of the Related Art

When a cigarette rod, which is twice as long as a cigarette, is supplied to a filter cigarette manufacturing apparatus or a so-called filter attachment, it is cut into two equal parts or individual cigarettes. Then, a filter plug is supplied between these cigarettes. A paper piece is wound around the two cigarettes and the plug to connect them, thus forming a double filter cigarette. Thereafter, the double filter cigarette is cut in the center into individual filter cigarettes.

As these processes are executed, cigarette elements, such as cigarette rods, cigarettes, double filter cigarettes or single filer cigarettes, are transported continuously on a drum train of the filter attachment. The drum train includes a number of transportation drums, which are arranged continuously with one another, and transportation grooves for receiving the cigarette elements by suction are formed on the outer peripheral surface of each drum. Thus, as the transportation drums of the drum train rotate, the cigarette elements are transported in a manner such that they are delivered between the drums.

In the drum train of the filter attachment, one of the transportation drums for transporting the double or single filter cigarettes is formed as an inspection drum, and another transportation drum which is situated on the downstream side of the inspection drum is formed as a discharge drum. If defective filter cigarettes, double or single, are detected on the inspection drum, these defective are then removed from the discharge drum to the outside of the drum train.

The defectives are removed by supplying transportation grooves of the discharge drum with compressed air whose pressure surpasses the suction pressure. More specifically, each transportation groove of the discharge drum has jet holes. When the transportation groove reaches a predetermined rotational angle zone of the discharge drum, the jet holes are connected to a positive-pressure line in the discharge drum, whereby the compressed air is ejected from the jet holes to remove the defectives from the transportation grooves.

The positive-pressure line is provided with a solenoid valve in the middle. This valve closes the line when non-defectives in the transportation grooves pass the aforesaid rotational angle zone. In this case, therefore, the compressed air cannot be ejected from the jet holes of those transportation grooves, so that the non-defectives are transferred from the discharge drum to the next transportation drum.

According to this method of removing defectives, the compressed air must be ejected from the jet holes of each transportation groove of the discharge drum only when tills transportation groove passes the aforesaid rotational angle zone. If the start of the ejection of the compressed air from the jet holes is lagged, non-defectives, not defectives, in the subsequent transportation grooves will inevitably be removed. If the termination of the ejection of the compressed air is lagged, on the other hand, the non-defective in the subsequent transportation groove, as well as the defectives, will be removed in vain.

Accordingly, the solenoid valve requires high-speed switching operation. In modern high-speed versions of filter attachments, however, the speed of transportation of filter cigarettes on each transportation drum or the discharge drum is too high for the switching operation of the solenold valve to follow, so that defectives cannot be accurately removed.

Even though satisfactory responsiveness is secured for the switching operation of the solenoid valve itself, moreover, the valve-open period of this valve is very short. Therefore, a positive pressure cannot be adequately raised in the jet holes of each transportation groove, so that the ejection pressure of the compressed air is lowered. Thus, the defectives cannot be properly removed from the transportation grooves.

SUMMARY OF THE INVENTION

The object of the present invention is to provide a filter cigarette discharge apparatus easily applicable to a high-speed filter attachment and capable of accurately discharging defectives only.

The above object is achieved by a discharge apparatus of the present invention. This discharge apparatus is incorporated in a filter cigarette manufacturing system, which includes a drum train having a plurality of transportation drums continuous with one another and transporting cigarette elements, such as double or single filter cigarettes, in a manner such that the cigarette elements are successively delivered between the transportation drums.

The discharge apparatus comprises: a rotatable discharge drum replacing one transportation drum in the drum train, the discharge drum having transportation grooves, arranged at regular intervals in the circumferential direction on the outer peripheral surface thereof and adapted to receive and transport the cigarette elements as the discharge drum rotates, and a jet hole having one end opening into the transportation groove corresponding thereto, the respective one ends of the jet holes of each two adjacent transportation grooves opening in different positions with respect to the axial direction of the discharge drum; supply means for introducing compressed air into the jet hole of each transportation groove of the discharge drum as the transportation groove passes a rotational angle zone, the supply means including independent blow pressure lines as many as the opening positions of the jet holes in the transportation grooves with respect to the axial direction of the discharge drum; and valve means for independently opening and closing the blow pressure lines.

According to the discharge apparatus described above, when one of transportation grooves passes the rotational angle zone as the discharge drum rotates and the valve means is opened, the compressed air is supplied from each corresponding blow pressure line to the jet hole of the transportation groove. Thus, the cigarette element in the transportation groove are blown off to be removed to the outside of the drum train by the compressed air ejected from the jet hole.

Since the respective one ends of the jet holes of each two adjacent transportation grooves open in the different positions with respect to the axial direction of the discharge drum, a blow pressure line corresponding to the jet hole of a specified transportation groove can be kept open during a period between points of time before the specified transportation groove enters the rotational angle zone and after the rotational angle zone is passed by the specified transportation groove.

Thus, a long period can be secured between the opening and closing times for the blow pressure line, that is, for the compressed air supply, and the valve means does not require high-speed switching operation. Even though the filter cigarette manufacturing system is a high-speed version, therefore, the switching operation of the valve means can be performed with an allowance, and besides, a lag of transmission of a blow pressure from the valve means to each transportation groove can be compensated.

BRIEF DESCRIPTION OF THE DRAWINGS

The present invention will become more fully understood from the detailed description given herein below and the accompanying drawings which are given by way of illustration only. and thus, are not limitative of the present invention, and wherein.

DETAILED DESCRIPTION OF THE PREFERRED EMBODIMENTS

Figure 1:
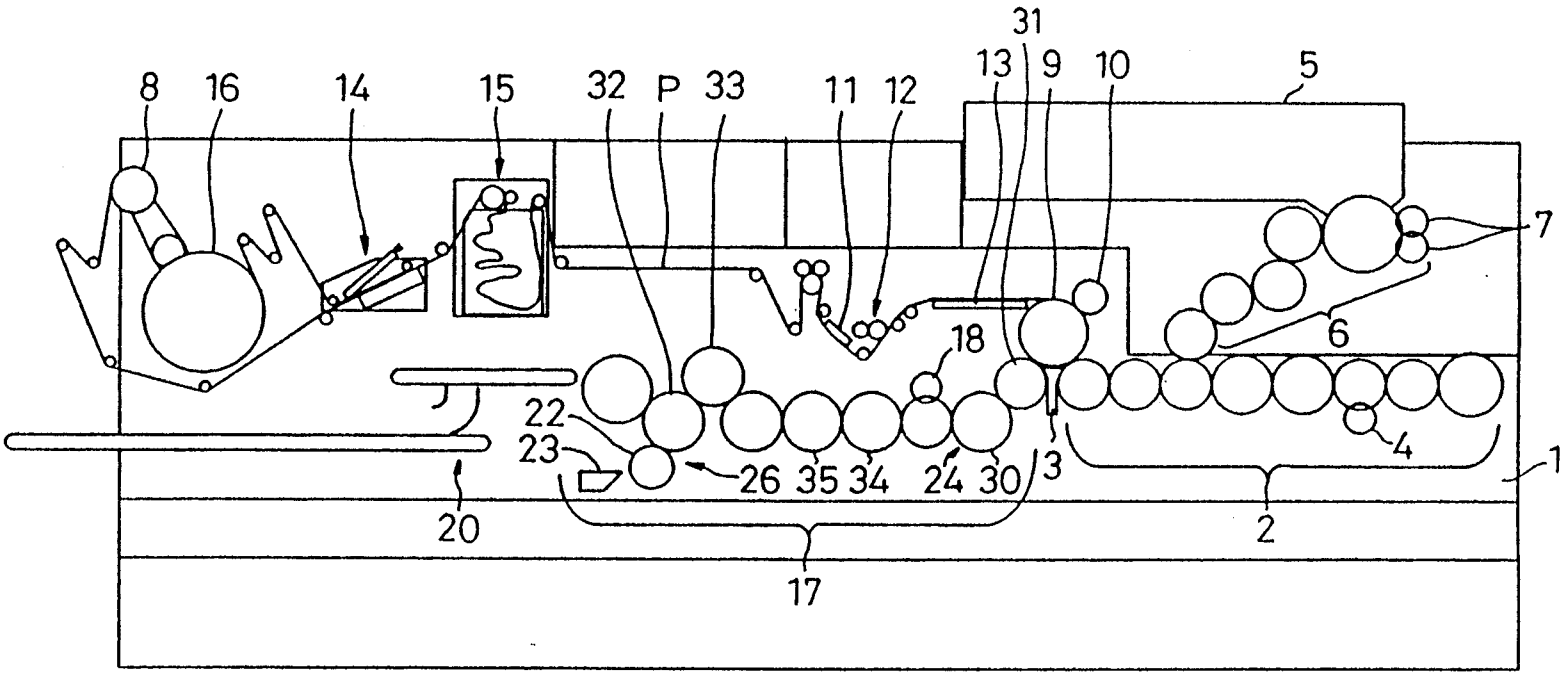
FIG. 1 is a schematic front view showing a filter attachment apparatus.

A filter attachment apparatus shown in FIG. 1 comprises an upright main frame 1. The main frame 1 is provided with a drum train 2 which extends to the left from the right-hand end thereof as in FIG. 1. The left-hand end of the drum train 2 is connected to a rolling section 3.

The drum train 2 includes a number of transportation drums, which are arranged in a row, and transportation grooves are formed on the outer peripheral surface of each drum. The grooves are arranged at regular intervals in the circumferential direction of the drum. Cigarette rods are fed to that transportation drum which is situated at the starting end of the drum train 2, and are held in the transportation grooves of the drum by suction, respectively. As this transportation drum rotates, the cigarette rods in the grooves are transported. The cigarette rods are delivered from the right-hand one of each two adjacent transportation drums to the left-hand one, as in FIG. 1. Thus, the cigarette rods are transported towards the rolling section 3 as they are repeatedly transferred between the individual transportation drums of the drum train 2.

Each cigarette rod fed to the drum train 2 is twice as long as a cigarette. In the process of transportation on the drum train 2, the cigarette rod is cut into two equal parts or cigarettes by means of a rotating circular knife 4, and thereafter, a predetermined space is secured between these two cigarettes. Thus, the rolling section 3 is supplied successively with pairs of cigarettes having the predetermined space between them.

Figure 2:
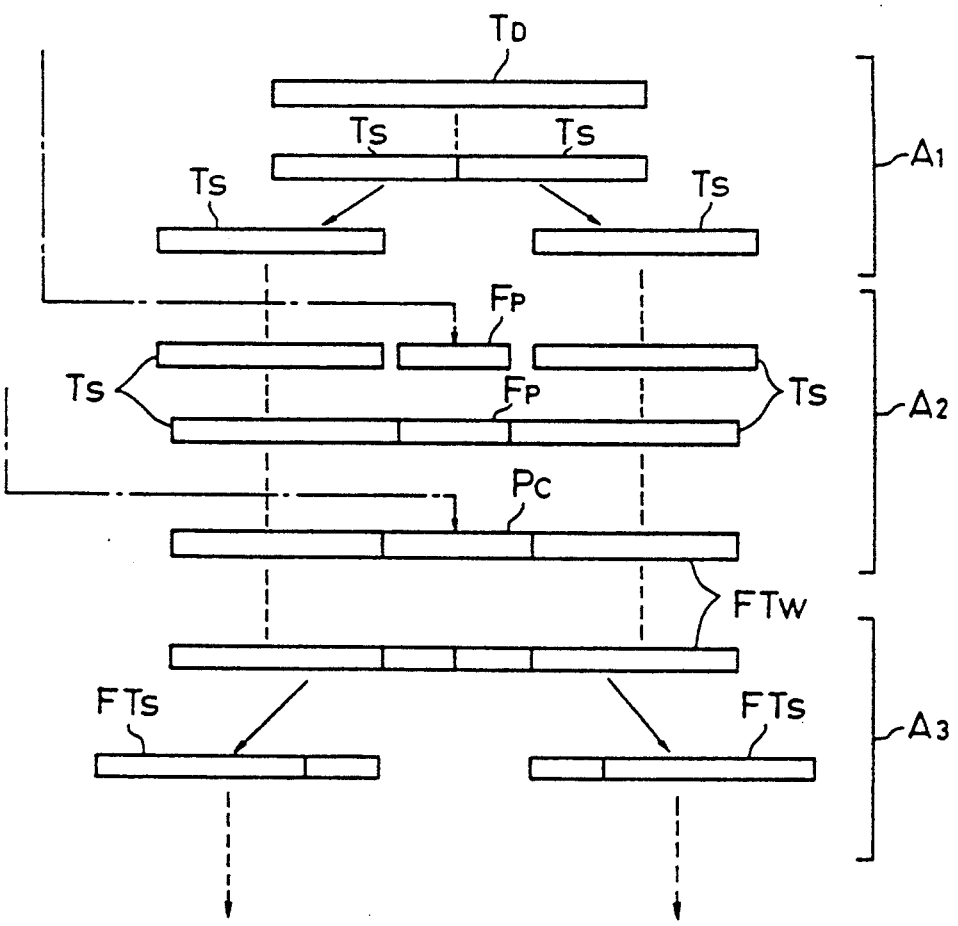
FIG. 2 is a diagram showing a flow of transportation of cigarettes in the filter attachment.

The aforementioned processing is represented by a region $A_1$ in FIG. 2. In this region, $T_D$ and $T_s$ indicate a cigarette rod and cigarette, respectively.

A hopper 5 is located over the drum train 2. The hopper 5 and the drum train 2 are connected to each other by means of a drum train 6, which resembles the drum train 2. A number of filter rods are stored in the hopper 5. The drum train 6 takes out the filter rods one by one from the hopper 5, and transports them to the drum train 2.

During this transportation, each filter rod is cut into a plurality of equal parts or individual filter plugs by means of rotating circular knives 7. As these filter plugs on the same axis pass a grading drum, which constitutes one transportation drum in the drum train 6, they are rearranged in front and in rear with respect to the transportation direction thereof. Thereupon, each filter plug is fed from the drum train 6 to the space between each two cigarettes transported on the drum train 2.

On the drum train 2, thereafter, the two cigarettes are brought individually into intimate contact with the opposite ends of the filter plug, whereupon they are supplied to the rolling section 3. In the rolling section 3, a paste-backed paper piece is wound around the two cigarettes and the filter plug. By doing this, the two cigarettes and the filter plug are connected to one another, whereupon a double filter cigarette is formed.

The paper piece is obtained by cutting a paper web P, which is paid out from a roll 8 at the left-hand end portion of the main frame 1. The supplied paper web P is guided to a receiving drum 9, which is situated right over the rolling section 3, and is attracted to the peripheral surface of the drum 9. Located in the vicinity of the receiving drum 9 is an edged drum 10 which serves to cut the paper web P in cooperation with the drum 9. The receiving drum 9 and the edged drum 10 rotate in opposite directions. As the paper web P passes between the drums 9 and 10, it is cut into paper pieces on the receiving drum 9 by the edged drum 10. As the receiving drum 9 rotates, thereafter, these paper pieces are fed to the rolling section 3. Blades (not shown) of the drum 10 can cut the paper web P in a manner such that they are not in contact with the peripheral surface of the receiving drum 9.

In a feed path for the paper web P between the roll 8 and the receiving drum 9, a preheater 11, a paster 12, and a post-heater 13 are successively arranged downstream in the region on the drum side. In the region on the roll side, a paper web connecting section 14 and a paper web storage section 15 are successively arranged downstream. A paper web paid out from a standby paper roll 16 is previously guided to the connecting section 14.

The processing from the supply of the filter plugs to the winding of the paper pieces is represented by a region $A_2$ in FIG. 2. In this region, $F_p$, $P_c$ and $FT_w$ indicate a filter plug, paper piece, and double filter cigarette, respectively.

A drum train 17, which resembles the aforesaid drum trains 2 and 6, extends to the left from the rolling section 3. The drum train 17 receives the double filter cigarette $FT_w$ from the rolling section 3 and transports it. During the transportation, the double filter cigarette $FT_w$ is cut in the center of its filter plug by means of a rotating circular knife 18, whereby two filter cigarettes are produced. Thereafter, a predetermined space is secured between these two filter cigarettes. This processing is represented by a region $A_3$ in FIG. 2. In this region, $FT_s$ indicates each filter cigarette.

A belt conveyor 20 is connected to the terminal end of the drum train 17. The conveyor 20 receives the filter cigarettes from the drum train 17, and feeds them to a packaging machine in the next stage.

Two discharge apparatuses are incorporated in the drum train 17. These discharge apparatuses serve to remove defective double filter cigarettes $FT_w$ or defective single filter cigarettes $FT_s$ from the drum train 17, respectively.

A discharge apparatus 24 for double filter cigarettes $FT_w$ includes an inspection drum 31 and a discharge drum 30 which are formed of the first and second transportation drums as counted from the starting end of the drum train 17. The inspection drum 31 inspects the double filter cigarette $FT_w$ received from the rolling section 3. If any defective filter cigarette $FT_w$ is found out in this inspection, it is removed from the discharge drum 30 to the outside of the drum train 17.

Likewise, a discharge apparatus 26 for single filter cigarettes $FT_s$ includes an inspection drum 33 and a discharge drum 32 which are formed of the fourth and fifth transportation drums as counted from the one furnished with the circular knife 18. Also in the case of the discharge apparatus 26, a defective filter cigarette $FT_s$, if detected by the inspection drum 33, is removed from the discharge drum 32 to the outside of the drum train 17.

The double filter cigarettes $FT_w$ are fed one by one from the rolling section 3 to the inspection drum 31 and the discharge drum 30. As is evident from the above description, however, the filter cigarettes $FT_s$ are fed two by two to the inspection drum 33 and the discharge drum 32. Thus, each two filter cigarettes, transported simultaneously, are inspected independently by means of the inspection drum 33. Based on the inspection results, the discharge drum 32 remove these paired filter cigarettes $FT_s$ independently of each other.

In the drum train 17, moreover, two transportation drums 34 and 35 which directly follow the transportation drum with the circular knife 18 are formed as separating drums. On receiving two filter cigarette $FT_s$ obtained by cutting a double filter cigarette $FT_w$, the separating drums 34 and 35 separate the filter cigarettes from each other, whereby the two filter cigarettes can be inspected independently on the inspection drum 33.

Figure 3:
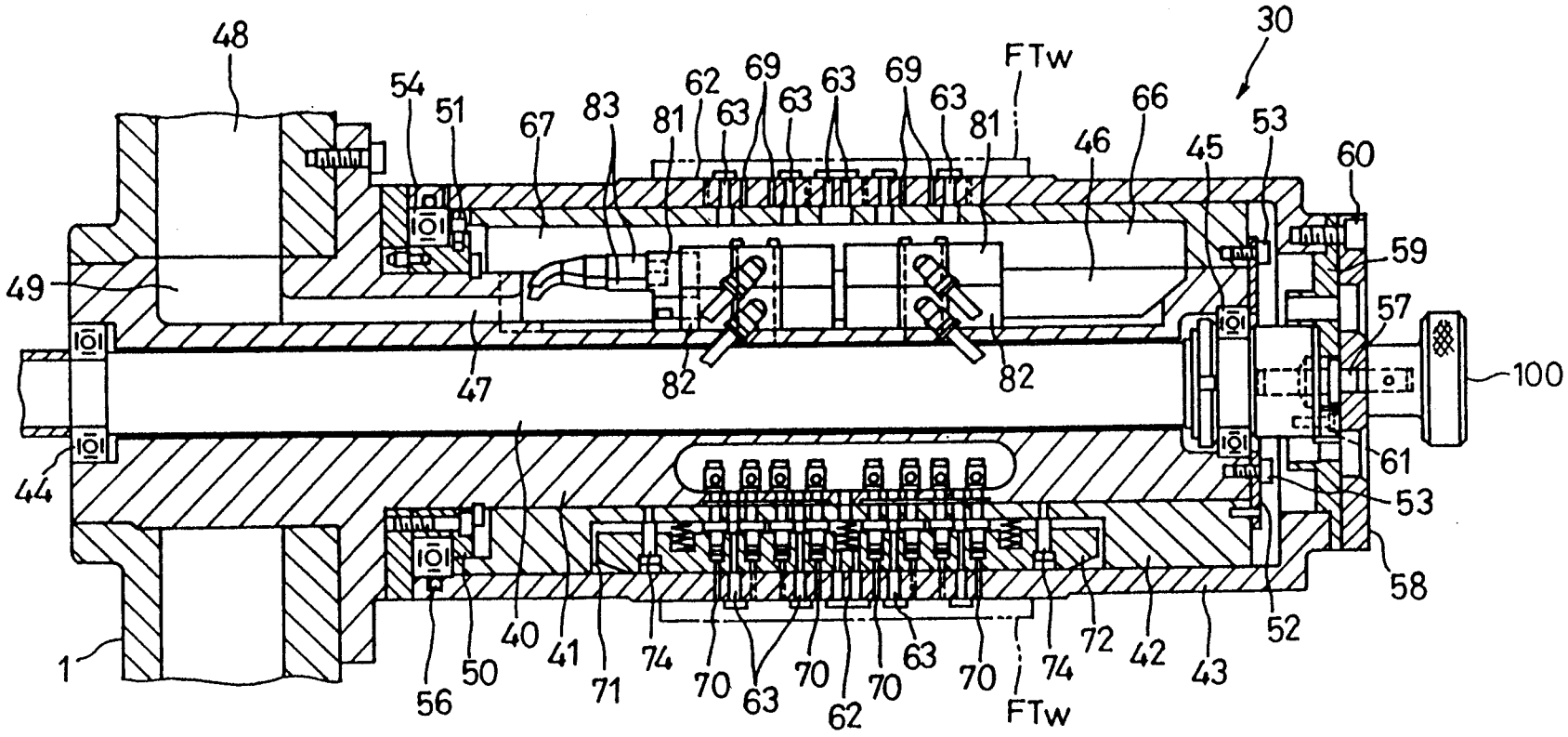
FIG. 3 is a longitudinal sectional view of a discharge drum.

FIG. 3 shows the discharge drum 30 of the discharge apparatus 24. The discharge drum 30 comprises a drive shaft 40 in its center, a stationary sleeve 41, a control sleeve 42, and a drum shell 43, the sleeves 41 and 42 and the shell 43 successively surrounding the shaft 40. An annular gap is secured between the drive shaft 40 and the stationary sleeve 41.

The drive shaft 40 is rotatably supported inside the stationary sleeve 41 by means of a pair of bearings 44 and 45. The stationary sleeve 41 is fixed in a manner such that its one end portion is fitted in the main frame 1. The drive shaft 40 projects from the one end of the stationary sleeve 41 into the inside of the main frame 1, and is connected to a power transmission system (not shown). Thus, the shaft 40 is rotated in one direction by means of power from the power transmission system.

A plurality of suction channels 46 are formed on the outer peripheral surface of the other end portion of the stationary sleeve 41. These channels 46, which are separated from each other in the circumferential direction of the stationary sleeve 41, extend for a predetermined length in the axial direction of the sleeve A bore 47 is formed inside the one end portion of the stationary sleeve 41. This bore 47 has the shape of a circular arc, as viewed in the cross section of the stationary sleeve 41, and extends in the axial direction of the stationary sleeve 41. One end of the bore 47 is connected to the suction channels 46, while the other end thereof is connected to a suction passage 48 in the main frame 1 by means of a connecting hole 49.

The suction passage 48 is connected to a negative-pressure source (not shown) such as a blower. This negative-pressure source supplies a fixed suction pressure to the suction channels 46 through the suction passage 48, connecting hole 49, and bore 47.

The control sleeve 42, which is mounted on the outer peripheral surface of the stationary sleeve airtightly covers the suction channels 46. One end of the control sleeve 42, which is situated on the main frame side, is supported on the stationary sleeve 41 by means of a support ring 50. The support ring 50 and the control sleeve 42 are connected to each other by a fixing pin 51, and the ring 50 is fixed on the stationary sleeve 41. On the other hand, the other end of the control sleeve 42 and the stationary sleeve 41 are integrally connected by means of a connecting disk 52 and a plurality of connecting screws 53.

The drum shell 43 is rotatably mounted on the control sleeve 42. The inner peripheral surface of the shell 43 is airtightly in sliding contact with the outer peripheral surface of the sleeve 42. One end of the drum shell 43 is rotatably supported on the support ring 50 by means of a bearing 54, and an O-ring 56 is interposed between the bearing 54 and the shell 43.

The other end of the drum shell 43, which extends beyond the other end of the control sleeve 42, is connected to the drive shaft 40. More specifically, the other end of the drive shaft 40 projects from the stationary sleeve 41, and a knob 100 is mounted on the projecting end by means of a connecting screw shaft 57. A drive disk 58 and a spacer disk 59 are sandwiched between the knob 100 and the projecting end of the drive shaft 40, and the outer peripheral edge of the drive disk 58 is connected to the other end face of the drum shell 43 through the spacer disk 59 by means of a plurality of connecting screws 60. The spacer disk 59 is connected to the drive shaft 40 by means of a key 61. Thus, the rotation of the drive shaft 40 is transmitted to the drum shell 43 through the drive disk 58, whereby the shell 43 is rotated integrally with the shaft 40.

Figure 4:
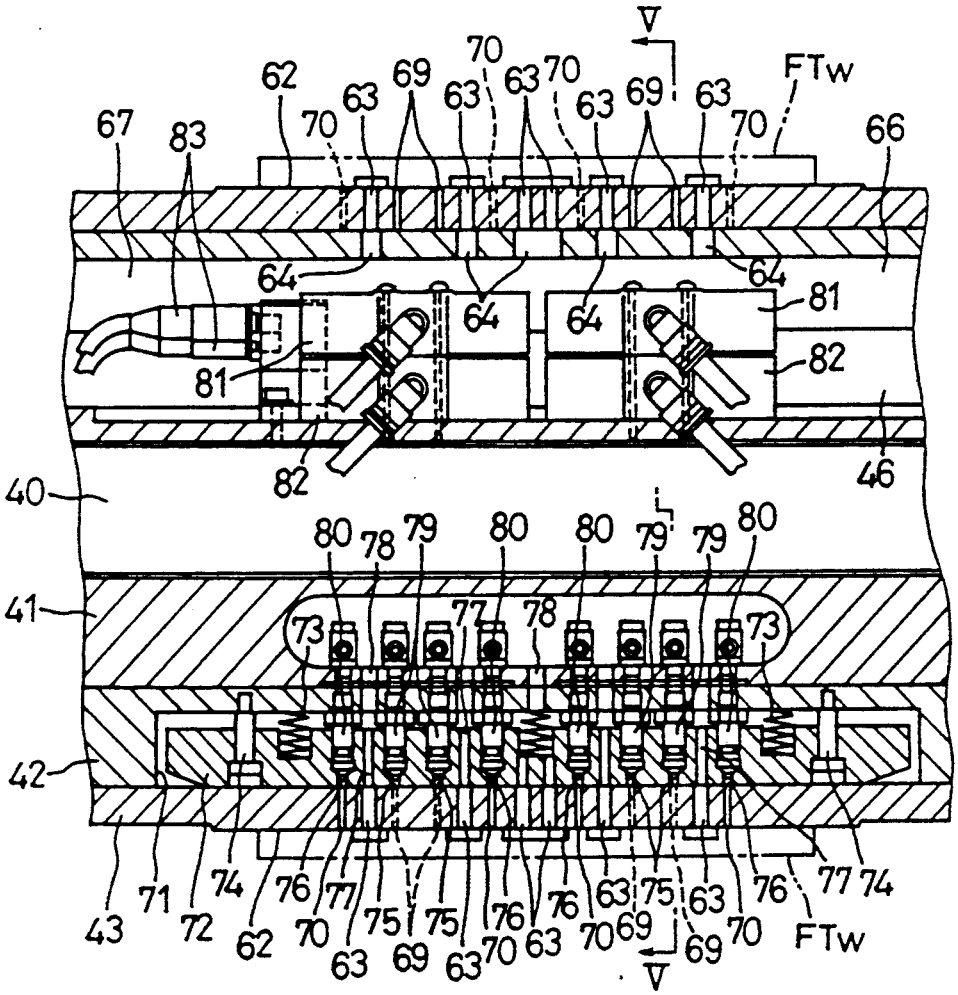
FIG. 4 is an enlarged view showing part of the discharge drum of FIG. 3.

A number of transportation grooves 62 are formed in the central region of the outer peripheral surface of the drum shell 43. The transportation grooves which have a semicircular cross section each, are arranged at regular intervals in the circumferential direction of the drum shell 43. As is more clearly shown in FIGS. 4 and 5, each transportation groove 62 is divided in the axial direction of the drum shell One end of each of six suction holes 63 opens in the bottom of each transportation groove 62, and the other end of each hole 63 in the inner peripheral surface of the drum shell 43.

Figure 5:
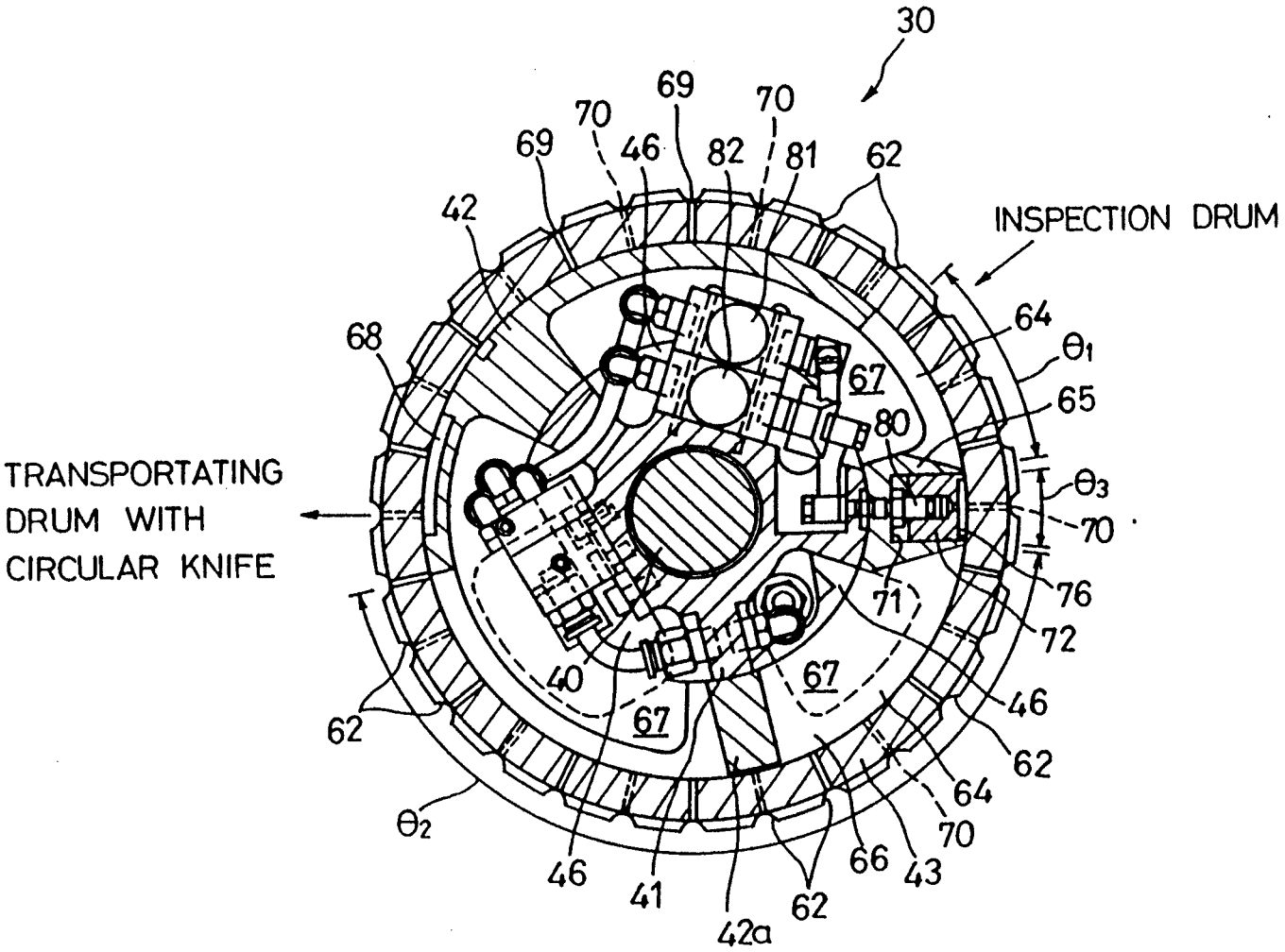
FIG. 5 is a sectional view taken along line V—V of FIG. 4.

On the other hand, a plurality of suction slots 64, which can be connected individually to the suction holes 63, are formed in the outer peripheral surface of the control sleeve 42. As shown in FIG. 5, these slots 64 are formed covering rotational angle zones $\theta_1$ and $\theta_2$ with respect to the rotating direction of the discharge drum 30 or the drum shell 43.

A separation wall 65 is provided in the control sleeve 42, corresponding to the region between the rotational angle zones $\theta_1$ and $\theta_2$. The wall extends in the axial direction of the sleeve 42. Thus, the separation wall 65 divides the suction slots 64 between the zones $\theta_1$ and $\theta_2$.

The starting end of the rotational angle zone $\theta_1$, as viewed with respect to the rotating direction of the drum shell 43, is situated just short of the point where the discharge drum 30 and the inspection drum 31 are located closest to each other, that is, the point of delivery of the double filter cigarettes. The terminal end of the rotational angle zone $\theta_2$ is situated just short of the point where the discharge drum 30 and the transportation drum with the circular knife 18 are located closest to each other.

In the rotational angle zone $\theta_2$ the suction slots 64 are divided by a partition wall 42*a*. A narrow gap is secured between the wall 42*a* and the inner peripheral surface of the drum shell 43.

A plurality of suction chambers 67 are formed in the control sleeve 42. These chambers 67 extend in the circumferential and axial directions of the sleeve 42. The suction chambers 67 communicate with the suction slots 64 on the one side, and are opened to the suction channels 46 of the stationary sleeve 41 on the other side. Thus, the suction slots 64 are continually connected to the suction passage 48 of the main frame 1 by means of the suction chambers 67 and the suction channels 46, so that a negative pressure or suction pressure in the suction passage 48 is supplied to the suction slots 64 at all times.

Further, a release groove 68, which is connected to the atmosphere side at all times, is formed on the outer peripheral surface of the control sleeve 42. The groove 68 is situated at a predetermined distance from the terminal end of the rotational angle zone $\theta_2$ with respect to the rotating direction of the drum shell 43.

Thus, when the drum shell 43 of the discharge drum 30 is rotated so that one of the transportation grooves 62 reaches the starting end of the rotational angle zone $\theta_1$, this transportation groove 62 is connected to the suction slots 64 of the control sleeve 42 by means of its suction holes 63, whereby the suction pressure is supplied to the groove 62. At this time, a double filter cigarette $FT_w$ in a transportation groove of the inspection drum 31 is attracted and received by the transportation groove 62 of the drum shell 43. While the transportation groove 62 passes the rotational angle zones $\theta_1$ and $\theta_2$ as the drum shell 43 rotates, thereafter, the double filter cigarette $FT_w$ is kept attracted to the groove 62. Thus, the double filter cigarette received by the transportation groove 62 is transported from the inspection drum 31 to the next transportation drum as the drum shell 43 rotates.

When the transportation groove 62 is connected to the release groove 68 of the control sleeve 42 through its suction holes 63, thereafter, the double filter cigarette $FT_w$ is released from suction, whereupon it is attracted and received from the discharge drum 30 by a transportation groove of the transportation drum with the circular knife 18. As this transportation drum rotates, the double filter cigarette $FT_w$ is transported.

Every other transportation groove 62 of the discharge drum 30 is provided with four jet holes 69, besides the suction holes 63. One end of each jet hole 69 opens in the bottom of its corresponding transportation groove 62, and the other end thereof in the inner peripheral surface of the drum shell 43.

The other transportation grooves 62 than the ones having the jet holes 69, that is, those transportation grooves 62 which are situated between the ones having the holes 69, are provided with four jet holes 70. One end of each jet hole 70 opens in the bottom of its corresponding transportation groove 62, and the other end thereof in the inner peripheral surface of the drum shell 43.

With respect to the group of transportation grooves 62 each having the four jet holes 69, those jet holes 69 which correspond to one another with respect to the circumferential direction of the drum shell 43 are situated on the circumference of the same circle. Also with respect to the group of transportation grooves 62 each having the four jet holes 70, those jet holes 70 which correspond to one another with respect to the circumferential direction of the drum shell 43 are situated on the circumference of the same circle. As seen from FIG. 4, however, the respective positions of the jet holes 69 and 70 of each two adjacent transportation grooves 62 differ from each other with respect to the axial direction of the transportation grooves 62. Thus, the jet holes 69 and 70 cannot be situated on the circumference of the same circle with respect to the circumferential direction of the drum shell 43.

A fitting hole 71 is formed in the separation wall 65 of the control sleeve 42. The hole 71 extends in the axial direction of the sleeve 42, and opens in the outer peripheral surface of the sleeve 42.

A nozzle holder 72 is fitted in the fitting hole 71, and a plurality of pressure springs 73 are arranged between the holder 72 and the base of the hole 71. The springs 73, which are situated at regular intervals in the longitudinal direction of the nozzle holder 72, press the holder 72 against the inner peripheral surface of the drum shell 43. Thus, the drum shell 43 rotates with its inner peripheral surface in sliding contact with the nozzle holder 72.

A pair of positioning guide pins 74 penetrate the opposite end portions of the nozzle holder 72, individually. The tip end of each pin 74 is screwed in the bottom of the fitting hole 71.

Figure 6:
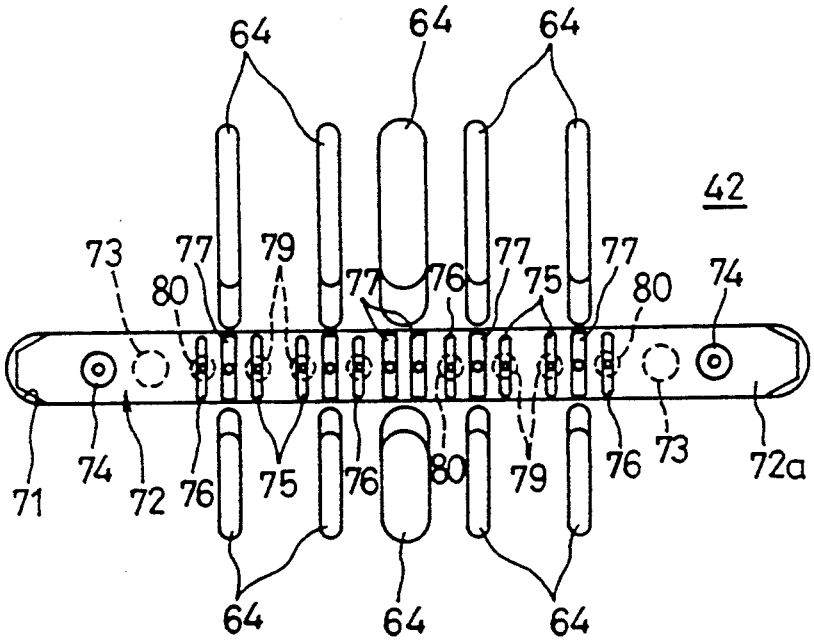
FIG. 6 is a view showing part of the outer peripheral surface of a control sleeve in the discharge drum.

As shown in FIG. 6, four jet grooves 75, four jet grooves 76, and six suction grooves 77 are formed in the outer surface of the nozzle holder 72, that is, a sliding contact surface 72*a* with respect to the drum shell 43. The jet grooves 75 are situated so as to be individually connectable to the jet holes 69 of the transportation grooves 62, while the jet grooves 76 are situated so as to be individually connectable to the jet holes 70 of the grooves 62. Further, the suction grooves 77 are situated so as to be individually connectable to the suction holes 63 of the transportation grooves 62.

The jet grooves 75 and 76 and the suction grooves 77 extend over a rotational angle discharge zone $\theta_3$ situated between the rotational angle zones $\theta_1$ and $\theta_2$, as shown in FIG. 5, with respect to the rotating direction of the drum shell The suction grooves 77 are connected to the suction chambers 67 by means of communication channels 78 (FIG. 4), individually. The channels 78 radially penetrate the control sleeve 42 and the stationary sleeve 41 from the bottom of the fitting hole 71.

Thus, as the double filter cigarette $FT_w$ transported together with the transportation groove 62 pass the rotational angle zone $\theta_3$, the suction holes are connected to the suction grooves 77 of the nozzle holder 72, so that the attraction of the double filter cigarettes is maintained.

Four jet nozzles 79 and another four jet nozzles 80 are mounted in the nozzle holder 72. The nozzles 79 are connected individually to the jet grooves 75, and the nozzles 80 to the jet grooves 76. Each two jet nozzles 79 are connected to a rejection valve 81 formed of a solenoid valve by means of a connecting pipe. Likewise, each two jet nozzles 80 are connected to a rejection valve 82 by means of a connecting pipe.

For simplicity of illustration, the layout of the connecting pipes for connecting the rejection valves and the jet nozzles is not shown.

The rejection valves 81 and 82 are connected to a common compressed air source (not shown), and pressure transducers 83 (see FIG. 4) are combined individually with the valves 81 and 82. The transducers 83 detect the pressure of compressed air supplied from the rejection valves to their corresponding jet nozzles, that is, blow pressure, and supply detection signals to a controller (not shown).

Based on the detection signals, the controller monitors the blow pressure supplied from the compressed air source to the jet nozzles 79 and 80, i.e., jet grooves 75 and 76, through the rejection valves 81 and 82, thereby correcting the timing for blowing off the double filter cigarettes $FT_w$ from the transportation grooves 62.

If a defective double filter cigarette $FT_w$ is detected by means of the inspection drum 31, according to the discharge apparatus 24 described above, that transportation groove 62 of the discharge drum 31 which is to receive the defective from the inspection drum 31 is specified thereafter. Since the inspection drum 31 and the discharge drum 30 rotate oppositely to each other in a manner such that their transportation grooves are in alignment, the transportation groove 62 can be easily specified on the basis of the number of transportation grooves of the drums 31 and 30 and the rotating speeds of the drums.

As the transportation groove 62 of the discharge drum 30 passes the nozzle holder 72 of the control sleeve 42, thereafter, the defective received by the groove 62 is blown off from the groove 62 by the compressed air ejected from the jet holes 69 or 70, and are removed to the outside of the discharge drum 30 or the drum train 17. The defective thus removed is received on a recovery conveyor (not shown) which is located under the drum train 17, and is transported to a dust box (not shown) by means of this conveyor.

In removing the defective, the corresponding rejection valves 81 or 82 are opened depending on whether the specified transportation groove 62 which receives the defective has the jet holes 69 or the jet holes 70. As a result, the blow pressure is supplied from these rejection valves to the jet nozzles 79 or 80 in the nozzle holder 72 through the corresponding connecting pipes.

When the jet holes of the specified transportation groove 62 is connected to the jet grooves of the nozzle holder 72 as the drum shell 43 rotates, the compressed air is ejected from those jet nozzles supplied with the blow pressure into the specified transportation groove 62 through the jet grooves. The ejected compressed air blows off the defective from the specified transportation groove 62. Thereafter, the rejection valves are closed, whereupon the supply of the blow pressure to the jet nozzles of the nozzle holder 72 is stopped.

The opening and closing times for the rejection valves 81 and 82 can be set in the following manner.

For ease of explanation, the specified transportation groove 62 is supposed here to have the jet holes 69. A suffix 0 is attached to the reference numeral for the specified transportation groove 62, and suffixes 1, 2, 3 and 4 are attached individually to the numerals for the two pairs of transportation grooves 62 on either side of the specified transportation groove 62 with respect to the rotating direction of the drum shell 43. As the drum shell 43 rotates, in this case, these transportation grooves advance in the order of 62, $62_2$, $62_o$, $62_3$ and $62_4$.

The paired rejection valves 81 corresponding to the specified transportation groove 62 are opened immediately after the rotational angle discharge zone $\theta_3$ is passed by the transportation groove $62_1$ (which, like the specified transportation groove $62_o$, has the jet holes 69), and the supply of the blow pressure from the rejection valves 81 to the jet nozzles 79 of the nozzle holder 72 is started. Even when the next transportation groove $62_2$ passes the rotational angle discharge zone $\theta_3$ in this state, the jet nozzles 79 supplied with the blow pressure cannot be connected to the jet holes 70 of the transportation groove $62_2$, so that the double filter cigarette in the groove $62_2$ is kept attracted as it passes the rotational angle discharge zone $\theta_3$ or the nozzle holder 72.

When the specified transportation groove 620 then advances to the rotational angle discharge zone $\theta_3$, the jet nozzles 79 supplied with the blow pressure are connected to the jet holes 69 of the groove $62_0$ through the jet grooves 75. As a result, the compressed air is ejected from the jet holes 69, and the defective is securely blown off from the specified transportation groove $62_o$ by the ejected compressed air. Thus, the defective is removed to the outside of the drum train 17.

Thereafter, the rejection valves 81 are closed immediately before the transportation groove $63_4$ (which, like the specified transportation groove $62_o$, has the jet holes 69) enters the rotational angle discharge zone $\theta_3$, so that the supply of the blow pressure from the valves 81 to the jet nozzles 79 is stopped. Although the jet nozzles 79 are supplied with the blow pressure while the transportation groove $62_3$ is passing the discharge zone $\theta_3$, in this ease, they cannot be connected to the jet holes 70 of the groove $62_3$.

As is evident from the above description, the rejection valves 81 can be opened for a period between the instant immediately after the rotational angle discharge zone $\theta_3$ is passed by the transportation groove $62_1$ and the instant immediately before the transportation groove $62_4$ enters the discharge zone $\theta_3$. Thus, a long valve-open period can be secured for the rejection valves 81.

In consideration of a lag in the transmission of the blow pressure between the rejection valves 81 and the jet nozzles 79, the valves 81 can be opened for a period between the instant immediately before the transportation groove $62_1$ passes the rotational angle zone $\theta_3$ and a point of time preceding the instant immediately before the transportation groove $62_4$ enters the zone $\theta_3$. Also in this case, the valveopen period of the rejection valves 81 cannot be shortened.

It is to be understood that the other rejection valves 82, like the rejection valves 81, can enjoy a long valve-open period.

If all the transportation grooves 62 have the same jet hole layout, in this connection, the rejection valves should be opened immediately after the rotational angle zone $\theta_3$ is passed by the transportation groove $62_2$ and be closed immediately before the transportation groove $62_3$ enters the zone $\theta_3$, so that the valve-open period of the rejection valves is very short.

Thus, according to the discharge apparatus of the present invention, a long period can be secured for the supply of the compressed air to the jet grooves 75 or 76 of the nozzle holder 72 to remove the defective. The long supply period for the compressed air ensures steady, well-timed switching operation of the rejection valves 81 and 82 and accurate and reliable removal of defectives.

If the long supply period can be secured for the compressed air, on the other hand, a time lag between the opening time for the rejection valves 81 or 82 and the actual rise of the compressed air pressure inside the corresponding jet nozzles 79 or 80 in the nozzle holder 72, that is, rejection pressure, can be compensated. Thus, when the rotational angle zone $\theta_3$ is reached by the specified transportation groove $62_O$, the rejection pressure is fully raised in the jet nozzles 79 or 80 of the nozzle holder 72, so that the defective in the groove 620 never fails to be blown off.

Figure 7:
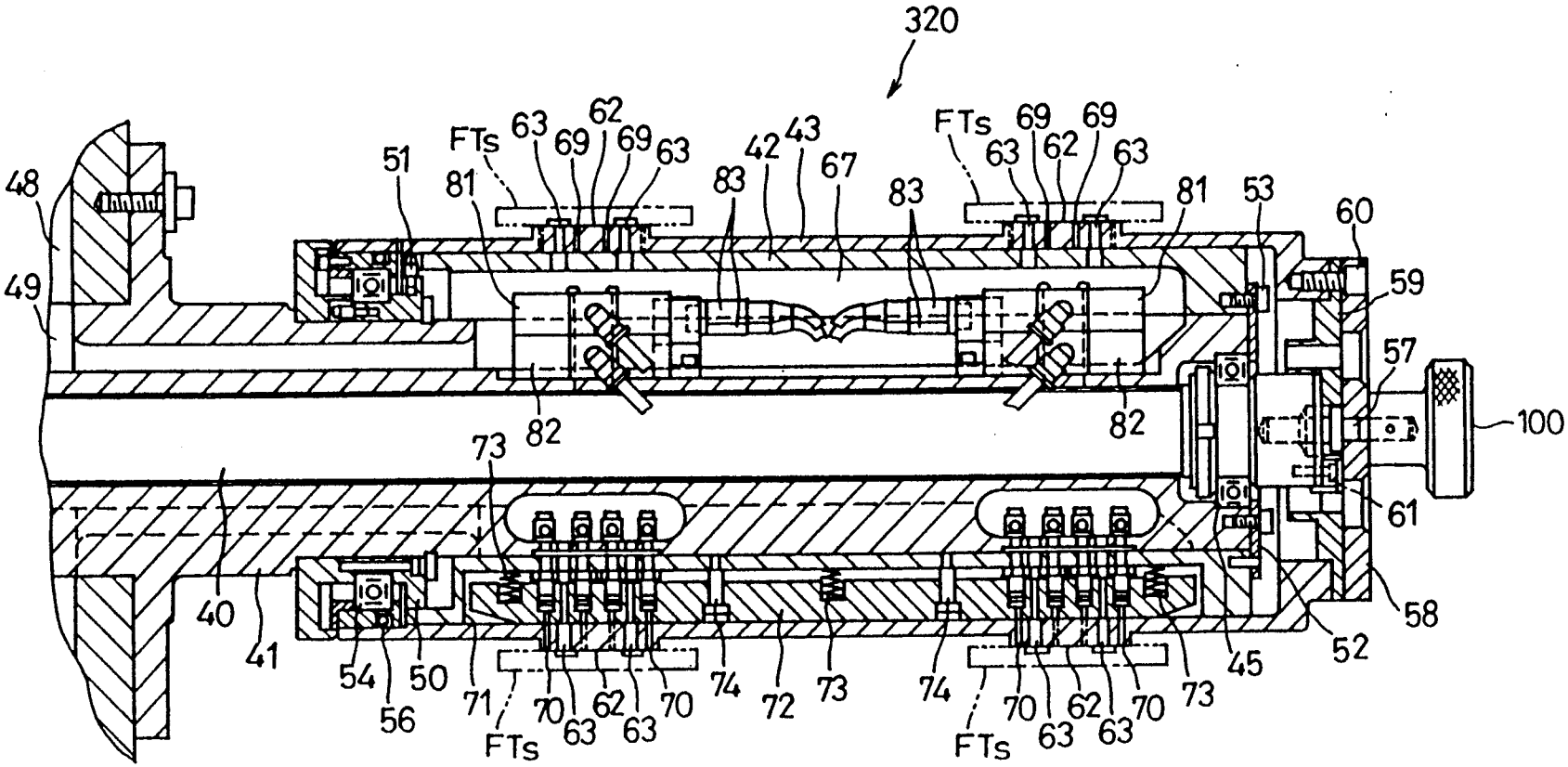
FIG. 7 is a longitudinal sectional view of another discharge drum.

As shown in FIG. 7, the discharge drum 32 of the discharge apparatus 26 is constructed in the same manner as the discharge drum 30 of the discharge apparatus 24. In FIG. 7, therefore, like reference numerals are used to designate like members and portions which have the same functions as their counterparts on the side of the discharge drum 30, and a description of those members and portions is omitted. The following is a description of only differences between the drums 32 and 30.

As is evident from the above description, the discharge drum 32 of the discharge apparatus 26 is supplied simultaneously with each two single filter cigarettes $FT_s$, obtained by halving a double filter cigarette $FT_w$, from its corresponding inspection drum 33. Therefore, a drum shell 43 of the discharge drum 32 is provided with two rows of transportation grooves 62. The grooves 62 in each row receive single filter cigarettes on the corresponding side from the inspection drum 33, and transport them as the drum shell 43 rotates. Thus, in the discharge drum 32, a discharge mechanism similar to the aforementioned one is provided independently for each row of transportation grooves 62.

Figure 8:
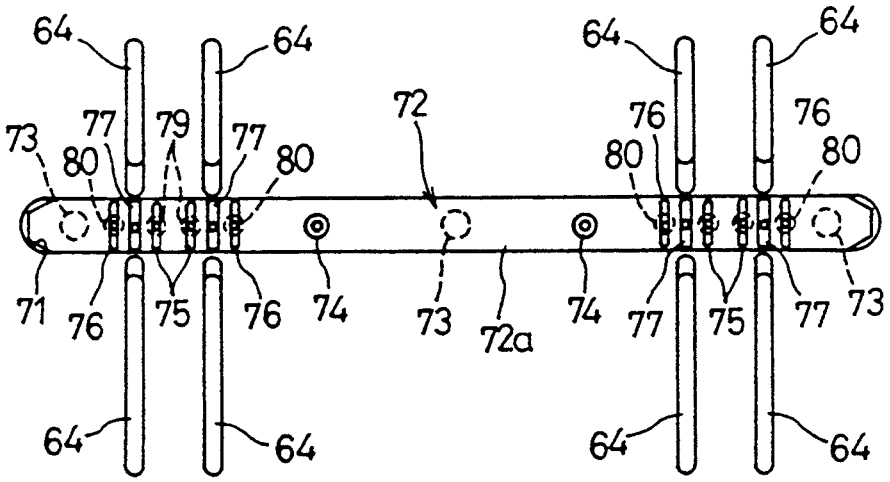
FIG. 8 is a view showing part of the outer peripheral surface of a control sleeve in the discharge drum of FIG. 7.

In the case of the discharge drum 32, as seen from FIG. 8, a common nozzle holder 72 is used for the individual rows of transportation grooves 62, and the number of jet grooves 75 and 76 associated with the rows of transportation grooves 62 is half that of the discharge drum 30. The reason is that defectives removed from the individual rows of transportation grooves 62 on the discharge drum 32 are not double filter cigarettes $FT_w$ but single filter cigarettes $FT_s$ whose length and weight are half those of the double filter cigarettes. Thus, blowing off each single filter cigarette $FT_s$ requires less compressed air ejection than that for each double filter cigarette $FT_w$.

The present invention is not limited to the embodiment described above, and various modifications may be effected therein. In the one embodiment, for example, the jet holes of each two adjacent transportation grooves are different in layout. By making each three continuous transportation grooves or more different in the jet hole layout, however, the period of compressed air supply to the jet nozzles can be further extended.

Although the present invention is applied to discharge apparatuses for defectives according to the embodiment described herein, moreover, it may be also applied to a sampling apparatus for selectively blowing off double or single filter cigarettes $FT_s$ or $FT_w$ to sample the same from a discharge drum.

What is claimed is:

1. Apparatus for transporting and discharging filter cigarette elements for use in a filter cigarette manufacturing system, said apparatus comprising a drum train having a plurality of rotary transportation drums disposed continuous with one another so as to transfer cigarette elements successively between adjacent said drums, one of said drums comprising a rotary discharge drum having an axis and a plurality of transportation grooves, arranged at regular intervals in the circumferential direction on the outer peripheral surface thereof and adapted to receive and transport the cigarette elements as said discharge drum rotates, each said transportation groove having at least one jet hole therein, said rotary discharge drum further comprising supply means for introducing compressed air into said at least one jet hole of each of said transportation grooves for discharging a cigarette element therein said transportation groove passes through a discharge zone during rotation of said rotary discharge drum, said supply means including a plurality of independent blow pressure lines, each of said blow pressure lines including an independent valve means for selectively connecting and disconnecting the blow pressure line to and from a compressed air supply, each of said jet holes being located in its transportation groove so as to be in communication with one of said blow pressure lines when its transportation groove passes through said discharge zone, wherein said jet holes and said blow pressure lines are arranged such that none of said transportation grooves has a jet hole therein capable of communicating with a blow pressure line capable of communicating with any jet hole in an adjacent transportation groove.

2. An apparatus according to claim 1, wherein said discharge drum includes a rotatable drum shell having the transportation grooves and said jet holes and a control sleeve fixed in the drum shell, each said jet hole having one end opening in the inner peripheral surface of the drum shell, the drum shell rotating with the inner peripheral surface thereof in sliding contact with the outer peripheral surface of the control sleeve; and each said blow pressure line includes jet grooves formed over the discharge zone on the outer peripheral surface of the control sleeve, the respective other ends of the jet holes of the transportation grooves being adapted to be connected to the jet grooves of the blow pressure lines corresponding thereto as the drum shell rotates.

3. An apparatus according to claim 2, wherein said supply means includes a member fitted in the outer peripheral surface of the control sleeve so as to comprise part of the outer peripheral surface, and urging means for pressing the member against the drum shell, the member having the jet grooves of said blow pressure lines.

4. An apparatus according to claim 1, wherein said valve means include solenoid valves arranged individually for said blow pressure lines and contained in said discharge drum.

* * * * *